US011325411B2

(12) United States Patent
Muraoka

(10) Patent No.: US 11,325,411 B2
(45) Date of Patent: May 10, 2022

(54) PRINTING BLANKET AND METHOD FOR MANUFACTURING PRINTING BLANKET

(71) Applicant: SHUHOU CO., LTD., Fukui (JP)

(72) Inventor: Kouji Muraoka, Fukui (JP)

(73) Assignee: SHUHOU CO., LTD., Fukui (JP)

( * ) Notice: Subject to any disclaimer, the term of this patent is extended or adjusted under 35 U.S.C. 154(b) by 228 days.

(21) Appl. No.: 16/624,837

(22) PCT Filed: Aug. 24, 2018

(86) PCT No.: PCT/JP2018/031375
§ 371 (c)(1),
(2) Date: Dec. 19, 2019

(87) PCT Pub. No.: WO2020/039578
PCT Pub. Date: Feb. 27, 2020

(65) Prior Publication Data

US 2021/0331509 A1 Oct. 28, 2021

(51) Int. Cl.
*B41N 10/04* (2006.01)

(52) U.S. Cl.
CPC ..... *B41N 10/04* (2013.01)

(58) Field of Classification Search
CPC ..... B41N 10/04; B41N 10/02; B41N 10/06; B41N 2210/04; B41N 2210/06; B41F 17/001
See application file for complete search history.

(56) References Cited

U.S. PATENT DOCUMENTS 4,281,032 A * 7/1981 Escort ..... B29C 33/60 106/38.22
2012/0318154 A1* 12/2012 Muraoka ..... B41F 17/001 101/401.1
2018/0222177 A1* 8/2018 Muraoka ..... B41N 10/02

FOREIGN PATENT DOCUMENTS

CN 202045045 U 11/2011
CN 204933975 U 1/2016
(Continued)

OTHER PUBLICATIONS

International Search Report (ISA) and Written Opinion (WO) dated Oct. 2, 2018 for Application No. PCT/JP2018/031375.
(Continued)

*Primary Examiner* — Leslie J Evanisko
*Assistant Examiner* — Leo T Hinze
(74) *Attorney, Agent, or Firm* — Ladas & Parry LLP

(57) ABSTRACT

A method for manufacturing a printing blanket including an elastic body that can be repeatedly used by removing a sheet is provided. According to the above of the present invention, the printing blanket includes an elastic body and a sheet bonded to the elastic body and performs printing by pressing the sheet against a printing object surface. The method includes a sheet fixing step of fixing the sheet at a periphery of a region in which the sheet is to be bonded to the elastic body; an elastic body placing step of placing the elastic body so that a bonding surface of the elastic body faces a bonding surface of the sheet that is fixed; a wax applying step of forming a wax layer on a surface of the elastic body; an adhesive applying step of applying an adhesive to at least one of the sheet and the elastic body that is provided with the wax layer on the surface thereof; and a pressing step of pressing the sheet and the elastic body against each other and bringing the sheet into close contact with the elastic body
(Continued)

provided with the wax layer such that the adhesive is interposed therebetween while stretching the sheet along the surface.

9 Claims, 5 Drawing Sheets

(56) References Cited

FOREIGN PATENT DOCUMENTS

| | | | |
|---|---|---|---|
| CN | 106497074 | A | 3/2017 |
| CN | 208124438 | U | 4/2017 |
| CN | 107124876 | A | 9/2017 |
| CN | 207274126 | U | 4/2018 |
| JP | 6920876 | A | 2/1984 |
| JP | 61118284 | A | 6/1986 |
| JP | 10119443 | A | 5/1998 |
| JP | 2004284267 | A | 10/2004 |
| KR | 1020170104919 | A | 9/2017 |
| TW | 201726437 | A | 8/2017 |
| WO | 0245961 | A1 | 8/2002 |
| WO | 2011108034 | A1 | 9/2011 |
| WO | 2017104087 | A1 | 6/2017 |

OTHER PUBLICATIONS

Japanese Office Action with an English translation dated Jul. 28. 2020 for Applicatlon No. JP 2020-504258.

Taiwanese Office Action with an English translation dated Aug. 26, 2020 for Application No. TW 103126796.

Korean Office Action with an English translation dated Oct. 30, 2020 for Application No. KR 10-2019-7033162.

Chinese office actian with an English translaticn dated Feb. 3, 2021 for Application No. CN 201880041769.4.

Taiwanese Office Action with an English translation dated Mar. 30, 2020 for Application No. TW 108126796.

* cited by examiner

PRINTING BLANKET AND METHOD FOR MANUFACTURING PRINTING BLANKET

RELATED APPLICATION

This application is an application under 35 U.S.C. 371 of International Application No. PCT/JP2018/031375 filed on Aug. 24, 2018, the entire contents of which are incorporated herein by reference.

TECHNICAL FIELD

The present invention relates to printing blankets and methods for manufacturing printing blankets, and more particularly to a printing blanket that is repeatedly usable by replacing a structure including a portion to which ink is transferred and a method for manufacturing the printing blanket.

BACKGROUND ART

Blanket printing is performed by pressing a printing surface of a printing blanket against a printing original plate to transfer ink provided on the printing original plate in a pattern corresponding to a print pattern onto the printing blanket. Subsequently, the printing surface of the printing blanket to which the ink has been transferred is pressed against a printing object surface so that the transferred ink is transferred onto the printing object surface. Thus, the print pattern is printed on the printing object surface.

For example, according to the related art, the printing blanket is a substantially hemispherical or substantially semi-cylindrical elastic body that is elastic (flexible) and made of, for example, a silicone rubber in which silicone oil is mixed. The printing blanket is pressed against a flat-plate-shaped printing original plate and a curved printing object surface to transfer ink to the printing object surface. Accordingly, in particular, an end (lowest point or lowest line) of the printing blanket and a portion therearound are deteriorated and damaged when pressed against the printing original plate or the printing surface, when pressed against the printing object surface having a projecting portion that causes a damage, or in other processes. The deterioration of and damage to the printing blanket in the limited region makes the printing blanket unusable.

The printing blanket needs to be soft (have a small elastic modulus and be easily elastically deformable) so that the printing blanket fits smoothly to the printing object surface. Accordingly, when the printing surface of the printing blanket is pressed against the printing original plate and deformed, silicone oil mixed in the printing blanket seeps to the surface of the printing blanket. In such a case, the ink applied to the printing original plate cannot be easily transferred (cannot easily move) from the printing original plate to the printing blanket, and the print pattern printed on the printing object surface may be faded or blurred.

In addition, when printing is repeated, ink and silicone oil excessively accumulate on the printing original plate and make the printing original plate dirty. When the printing blanket is pressed against the dirty printing original plate, dirt is transferred to the printing blanket. When printing is performed by using the dirty printing blanket, a dirty print pattern is printed on the printing object surface.

In addition, when printing is performed by using the printing blanket, a silicone oil component that has seeped out of the elastic body of the printing blanket adheres to the printing object surface. When a coating is formed on the printing object surface to which the silicone oil component has adhered, the coating is repelled by the silicone oil component. Therefore, a desired coating layer cannot be formed on the printing object surface.

If the amount of silicone oil contained in the silicone rubber that forms the printing blanket is reduced and the hardness of the silicone rubber is increased, it becomes difficult to print on a curved surface over a large area. Therefore, the printing region is limited to a small area, and sufficient design flexibility cannot be ensured. To print on a large area, a process of printing on a small area needs to be repeated a plurality of times. This results in an increase in the printing cost.

Therefore, according to the related art, a printing blanket having a printing surface formed by attaching a replaceable elastic sheet on a surface of an elastic body formed of a soft silicone rubber is used. According to the printing blanket having such a structure, the sheet may be replaced when, for example, the printing surface is deteriorated or damaged, and silicone oil does not seep out of the soft silicone rubber.

According to the invention disclosed in Patent Literature 1, a sheet that defines a printing surface of a blanket is fixed at the periphery of a region in which the sheet is to be bonded to an elastic body, and the elastic body is placed such that a bonding surface of the elastic body faces a bonding surface of the fixed sheet. An adhesive is applied to at least one of the bonding surface of the sheet and the bonding surface of the elastic body, and the bonding surface of the sheet and the bonding surface of the elastic body are pressed against each other so that the sheet is brought into close contact with the elastic body with the adhesive interposed therebetween while being stretched along the surface of the elastic body. Thus, the printing blanket is formed by attaching the sheet to the surface of the elastic body. Accordingly, when the sheet bonded to the printing blanket is deteriorated or damaged, the sheet can be removed from the elastic body and a new sheet can be attached by the same process. Thus, the elastic body of the printing blanket can be repeatedly used.

CITATION LIST

Patent Literature

Patent Literature 1: International Publication No. 2017/104087

SUMMARY OF INVENTION

Technical Problem

However, the printing blanket disclosed in Patent Literature 1 is formed by attaching the sheet to the surface of the elastic body with the adhesive, and therefore the sheet, the adhesive, and the elastic body are strongly fixed together. Therefore, when the sheet is removed from the surface of the elastic body to replace the sheet, the removed sheet has the adhesive and the surface of the elastic body attached thereto, and the surface of the elastic body is damaged. In addition, there is a risk that the sheet cannot be removed from the surface of the elastic body and that the entire printing blanket will need to be discarded.

The present invention has been made to solve the above-described problem, and provides a printing blanket and a method for manufacturing the printing blanket. The printing blanket allows easy removal of a sheet attached to an elastic body during repair of the printing blanket, and is continuously usable for a long time by replacing the sheet.

Solution to Problem

According to a method for manufacturing a printing blanket according to an embodiment of the present invention, the printing blanket includes an elastic body and a sheet bonded to the elastic body and performs printing by pressing the sheet against a printing object surface. The method includes a sheet fixing step of fixing the sheet at a periphery of a region in which the sheet is to be bonded to the elastic body; an elastic body placing step of placing the elastic body so that a bonding surface of the elastic body faces a bonding surface of the sheet that is fixed; a wax applying step of forming a wax layer on a surface of the elastic body; an adhesive applying step of applying an adhesive to at least one of the sheet and the elastic body that is provided with the wax layer on the surface thereof; and a pressing step of pressing the sheet and the elastic body against each other and bringing the sheet into close contact with the elastic body provided with the wax layer such that the adhesive is interposed therebetween while stretching the sheet along the surface.

A printing blanket according to another embodiment of the present invention includes an elastic body; a wax layer that covers a surface of the elastic body; an adhesive that covers the wax layer; and a sheet that covers the adhesive, and a surface of the sheet includes a printing surface to which ink is transferred.

Advantageous Effects of Invention

According to the embodiments of the present invention, the wax layer is provided on the surface of the elastic body when the sheet, which defines a printing surface of the printing blanket, is attached. Accordingly, the sheet can be attached in a manner similar to that in the related art, and can be easily removed when the printing blanket is repaired. Thus, a thin sheet is attached to the surface of the printing blanket, and the sheet is replaceable so that damage to the elastic body, which requires high manufacturing cost, is reduced. Therefore, the elastic body can be repeatedly used. Since the printing blanket can be used for a long time by replacing only the sheet, which is inexpensive, the printing cost can be reduced.

DESCRIPTION OF EMBODIMENTS

Embodiment 1

Figure 1:
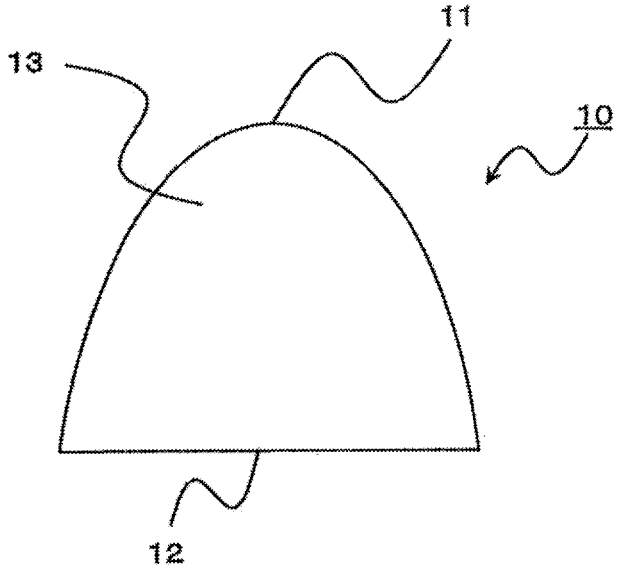
FIG. 1 is a side view illustrating an example of a printing blanket according to Embodiment 1 of the present invention.

A printing blanket and a method for manufacturing the printing blanket according to the present invention will now be described with reference to the drawings. The present invention is not limited to the embodiments described below. In the drawings, the same elements are denoted by the same reference symbols, and description thereof is partially omitted. The drawings are schematically illustrated, and the present invention is not limited to the illustrated forms (in particular, the thicknesses of a sheet, an adhesive, and a wax layer are exaggerated). In this specification, the terms "elastic body" and "elastic" are not limited to a case in which applied load and an amount of deformation caused by the load are in a linear relationship. The terms are also used to refer to a case in which applied load and an amount of deformation caused by the load are in a non-linear relationship and in which the original shape is restored immediately or after a certain delay time when the applied load is eliminated.

<Printing Blanket 10>

FIG. 1 is a side view illustrating an example of a printing blanket 10 according to Embodiment 1 of the present invention. The printing blanket 10 illustrated in FIG. 1 has, for example, a substantially hemispherical shape. When the printing blanket 10 is placed such that a flat surface of the substantially hemispherical shape faces downward and is defined as a bottom surface 12, the distance from the center of the bottom surface 12 to an apex 11 is greater than that of a general hemisphere having the bottom surface 12 of the same size. In other words, the printing blanket has a bullet-like shape. The shape of the blanket is not limited to this, and may be, for example, a hemispherical shape, a shape of a curved surface obtained by rotating a parabola about the symmetry axis thereof, a shape obtained by partially cutting an ellipsoid, a shape obtained by linearly and continuously extending a bullet shape or a semicircular shape. The shape of the blanket may be changed as appropriate in accordance with, for example, the specifications of a printing object. In Embodiment 1, a portion of the surface of the printing blanket 10 in a predetermined area having the apex 11 at the center serves as a printing surface 13 to which ink is transferred from a printing original plate and from which the ink is transferred to the printing object.

Figure 2:
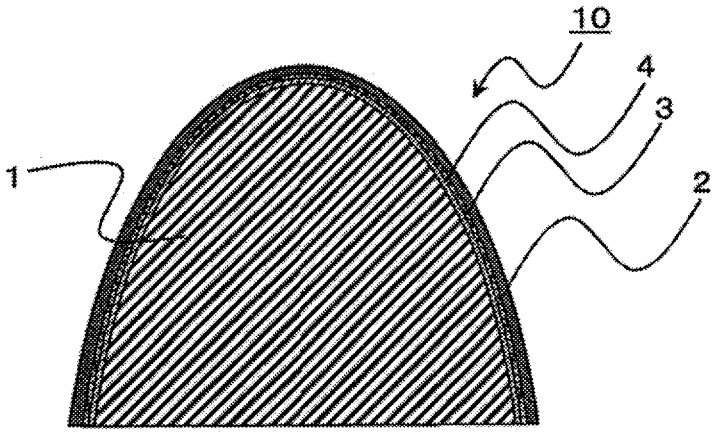
FIG. 2 is a sectional view of the printing blanket illustrated in FIG. 1.

FIG. 2 is a sectional view of the printing blanket 10 illustrated in FIG. 1. The sectional view is taken along a plane that passes through the apex of the printing blanket 10 and that is perpendicular to the bottom surface 12. As illustrated in FIG. 2, the printing blanket 10 includes an elastic body 1 and a sheet 2 that is attached to the elastic body 1 and that extends along the curved surface of the elastic body 1. A wax layer 3 that is in contact with the surface of the elastic body 1 and an adhesive 4 that is provided on the wax layer 3 are disposed between the elastic body 1 and the sheet 2.

<Elastic Body 1>

The elastic body 1 is formed by, for example, molding a silicone rubber. The elastic body 1 has silicone oil mixed therein so that the elastic body 1 is elastic (flexible) and easily deformable. Although the elastic body 1 is bullet-shaped similarly to the printing blanket 10 in Embodiment 1, the shape of the elastic body 1 may be changed as appropriate in accordance with the specifications of the printing object. The elastic body 1 may have any shape as long as the elastic body 1 is deformed so that ink applied to the printing original plate (not shown) in a print pattern can be transferred to the sheet 2 when the printing blanket 10 is pressed against the printing original plate. The material (substance) of the elastic body 1 is not limited as long as the ink that has been transferred to the sheet 2 can be transferred to a printing object surface (not shown) when the printing blanket 10 is pressed against the printing object surface.

For example, the elastic body 1 may be formed of two materials having different hardnesses. In such a case, for example, the Asker C hardness of the material of a portion of the elastic body 1 that is adjacent to the printing surface is set in the range of 50 to 70 points. The Asker C hardness of the material of a portion of the elastic body 1 to which a pressing force is applied to press the elastic body 1 against the printing object surface during printing is set to 100 points. Referring to FIG. 1, the Asker C hardness of a lower portion of the elastic body 1 is set to 10 points, and the Asker C hardness of an upper portion (portion including the apex 11) of the elastic body 1 is set in the range of 5 to 7 points. To enable the printing blanket 10 to be deformed to follow the printing object surface, the elastic body 1 preferably has a low hardness. Therefore, the hardness of the portion of the elastic body 1 that is adjacent to the surface pressed against the printing object surface is set to a low hardness. However, the hardness of each portion of the elastic body 1 is not limited by the above description.

<Sheet 2>

The sheet 2 is formed of a sheet-shaped silicone rubber having a predetermined thickness (for example, 0.5 mm). In Embodiment 1, for example, a silicone rubber having a higher hardness and containing less silicone oil than the silicone rubber that forms the elastic body 1 is used. However, the material of the sheet 2 is not limited to this. There is no limitation regarding the sheet 2 as long as the ink applied to the printing original plate in the print pattern can be transferred thereto when the printing blanket 10 is pressed against the printing original plate (not shown). Also, there is no limitation regarding the sheet 2 as long as the ink that has been transferred thereto can be transferred to the printing object surface (not shown) when the printing blanket 10 is pressed against the printing object surface. Furthermore, there is no limitation regarding the sheet 2 as long as the sheet 2 is sufficiently stretchable so that the sheet 2 can be attached to the elastic body 1 along the surface thereof in the step of attaching the sheet 2 to the elastic body 1 described below.

<Wax Layer 3>

The wax layer 3 is provided on the surface of the elastic body 1. The wax layer 3 is made of a wax that is a soft solid at room temperature and that has a relatively high viscosity but can be applied to the surface of the elastic body 1. The wax may include, for example, carnauba wax, and is water-repellent. The wax layer 3 may be partly or entirely mixed with the adhesive 4 when the adhesive 4 is applied thereto. In other words, the layer formed of the adhesive 4 may include a layer in which the adhesive 4 and the wax layer 3 are mixed.

<Adhesive 4>

The adhesive 4 is provided on the wax layer 3. The adhesive 4 has a viscosity such that the adhesive 4 flows downward along the surface of the wax layer 3 due to gravity when the adhesive 4 is placed on the surface of the elastic body 1 to which the wax layer 3 is applied. The adhesive 4 is cured over time and bonded to materials that are in contact therewith, but remains elastic enough to be deformed in accordance with the deformation of the elastic body 1 and the sheet 2.

<Functions of Elastic Body 1 and Sheet 2>

In Embodiment 1, the printing blanket 10 is pressed against the printing original plate from the apex 11, and is deformed. The printing blanket 10 is pressed against the printing original plate over a predetermined region having the apex 11 at the center. The predetermined region is referred to as the printing surface 13. For example, ink on the printing original plate is transferred to the printing surface 13 of the printing blanket 10. After that, the printing surface 13 is pressed against the printing object, so that the ink that has been transferred to the printing surface 13 is transferred to the printing object. The elastic body 1 is made of a silicone rubber containing a large amount of silicone oil, and is therefore easily deformed. The sheet 2 attached to the surface of the elastic body 1 is made of a silicone rubber having a hardness higher than that of the elastic body 1. However, the sheet 2 is thin-sheet-shaped, and therefore follows the deformation of the elastic body 1. The material of the sheet 2 is not limited to the silicone rubber having a hardness higher than that of the elastic body 1. The hardness and material of the sheet 2 may be selected as appropriate as long as the sheet 2 follows the deformation of the elastic body 1.

The wax layer 3 and the adhesive 4 disposed between the elastic body 1 and the sheet 2 are deformed in accordance with the deformation of the elastic body 1 and the sheet 2. The wax layer 3 and the adhesive 4 are thinner than the sheet 2, and therefore follow the deformation of the elastic body 1 even when the hardnesses thereof are high.

As described above, the printing blanket 10 is easily deformable, and therefore easily and smoothly follows the curved printing object surface. The sheet 2 is formed of the silicone rubber having a hardness higher than that of the elastic body 1. The sheet 2 contains less silicone oil than does the elastic body 1. Therefore, when the printing blanket 10 is deformed, the silicone oil mixed in the elastic body 1 is substantially sealed by the sheet 2 that surrounds the elastic body 1. Since the amount of silicone oil mixed in the sheet 2 is small, the silicone oil does not easily seep out to the printing surface 13 defined by the sheet 2. In addition, the sheet 2 is made of a material having a higher hardness and smaller thickness than the elastic body 1, and is therefore, for example, less prone to damage. Therefore, the printing blanket 10 including the elastic body 1 having the sheet 2 on the surface thereof is highly durable and is usable for a long time.

Although the printing blanket 10 has the printing surface 13 defined by a single sheet 2, the printing blanket 10 is not limited to this. The sheet 2 may have one or two additional sheets 2 provided thereon. In such a case, the wax layer 3 and the adhesive 4 are provided between the sheets 2. Alternatively, the sheets 2 may have only the adhesive 4 provided therebetween. In such a case, the printing blanket has a multilayer structure, such as a three-layer structure or a four-layer structure. In addition, although the sheet 2 is configured to cover the entire surface of the printing blanket 10 in FIG. 2, the sheet 2 may instead be configured to only partially cover the surface of the printing blanket 10.

<Method for Manufacturing Printing Blanket 10>

Figure 3:
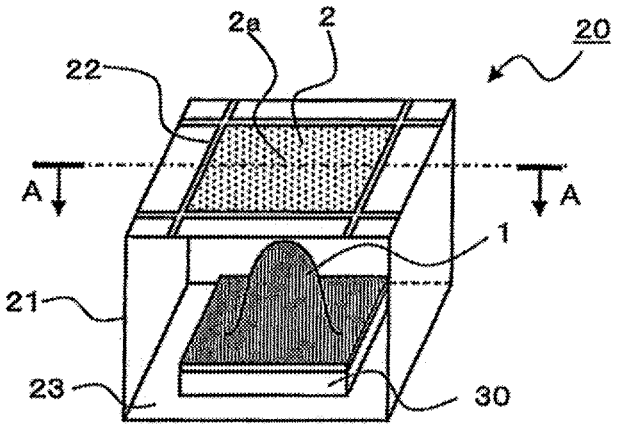
FIG. 3 is a schematic diagram illustrating a sheet attaching device according to Embodiment 1.
Figure 4:
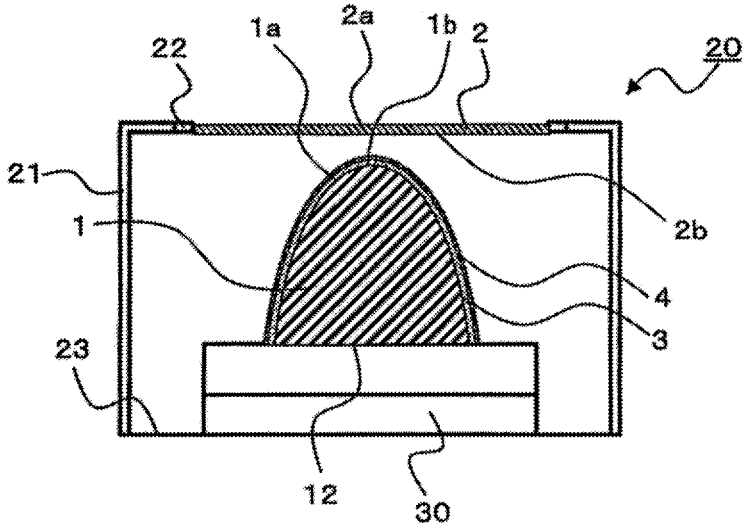
FIG. 4 is a schematic sectional view of the sheet attaching device illustrated in FIG. 3 taken along line A-A.

FIG. 3 is a schematic diagram illustrating a sheet attaching device 20 according to Embodiment 1. FIG. 4 is a schematic sectional view of the sheet attaching device 20 illustrated in FIG. 3 taken along line A-A. A method for manufacturing the printing blanket 10 will now be described with reference to the drawings.

<Step of Fixing Sheet 2>

The sheet 2 is fixed at the periphery of a region in which the sheet 2 is to be bonded to the elastic body 1. This step is referred to as a sheet fixing step. The sheet 2, which has a predetermined size (thickness, length, and width), may be formed either by forming the sheet 2 in the predetermined size or by cutting an original sheet having a large area into a predetermined rectangular shape (length and width).

A stand 21 to which the sheet 2 is fixed has a frame 22 on an upper portion thereof. The sheet 2 is fixed to the frame 22 at the periphery of the region in which the sheet 2 is to be bonded to the elastic body 1 (hereinafter referred to as a bonding region 2*a*). The sheet 2 may either be fixed to the frame 22 along the entire periphery of the bonding region 2*a* in which the sheet 2 is to be bonded to the elastic body 1, or be fixed to fixing portions provided at a plurality of positions. For example, the sheet 2 may be fixed with pins. Alternatively, the frame 22 may have a structure for fixing the sheet 2 by clamping the sheet 2 in the thickness direction, and the sheet 2 may be fixed by being clamped. As described below, the elastic body 1 is pressed against the sheet 2 in a direction from the bottom to the top of the stand 21. At this time, the portions of the sheet 2 that are fixed to the frame 22 at the periphery of the bonding region 2*a* are unmovable form the fixed positions. The sheet 2 is stretched, and the portions of the frame 22 to which the sheet 2 is fixed receive a tensile load due to the elastic force of the sheet 2, but do not release the sheet 2.

Although the frame 22 is square and surrounds the bonding region 2*a* in FIG. 3, the shape of the frame 22 is not limited to this. The frame 22 may instead have, for example, a circular shape. The shape of the frame 22 may be changed as appropriate in accordance with, for example, the method for fixing the sheet 2 and the shape of the elastic body 1.

<Step of Placing Elastic Body 1>

In Embodiment 1, the elastic body 1 is formed in a bullet shape. The elastic body 1 is placed such that the bottom surface 12 thereof is on the top surface of a lifter 30. This step is referred to as an elastic body placing step. The elastic body 1 is placed on the stand 21 in a region below the fixed sheet 2. The elastic body 1 is placed such that a bonding surface 1*a* thereof to which the sheet 2 is to be bonded faces a bonding surface 2*b* of the sheet 2. In addition, the elastic body 1 is placed such that the apex of the bullet shape is substantially at the center of the bonding region 2*a* of the sheet 2.

The lifter 30 is mounted on a bottom surface 23 of the stand 21, which is box-shaped, and is structured so that the distance from the bottom surface 23 to the frame 22 does not change even when the sheet 2 is pushed upward in a pressing step described below.

<Wax Layer Applying Step>

Figure 5:
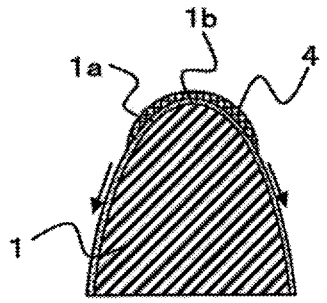
FIG. 5 is a sectional view illustrating a state in which an adhesive is placed on an elastic body according to Embodiment 1.
Figure 6:
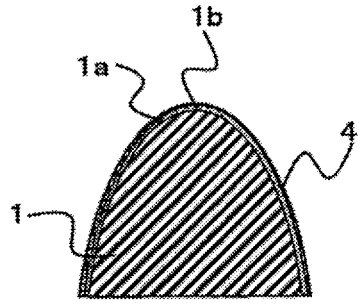
FIG. 6 illustrates a state in which the adhesive has flowed from the state illustrated in FIG. 5.

FIG. 5 is a sectional view illustrating a state in which the adhesive 4 is placed on the elastic body 1 according to Embodiment 1. FIG. 6 illustrates a state in which the adhesive 4 has flowed from the state illustrated in FIG. 5. The cross section of FIG. 5 is perpendicular to the bonding surface 2*b* of the sheet 2, and passes through an apex 1*b* of the elastic body 1. The wax layer 3 is thinly applied to the surface of the elastic body 1. The wax that forms the wax layer 3 has a viscosity such that the wax does not flow along the surface of the elastic body 1 having a substantially hemispherical shape. An operator forms the wax layer 3 by placing the wax on the surface of the elastic body 1 and then substantially uniformly spreading the wax over the entire surface of the elastic body 1. The wax layer 3 may be formed by applying the wax a plurality of times. The wax may be applied a plurality of times only on a portion of the surface of the elastic body 1 including the apex 1*b* of the elastic body 1. The thickness of the wax layer 3 is increased when the wax is applied a plurality of times. Therefore, the thickness of the wax layer 3 on the surface of the elastic body 1 may be increased only in a partial region including the apex 1*b*. The above-described step is referred to as a wax layer applying step. The apex 1*b* of the elastic body 1 is a portion that comes into contact with the sheet 2 first in the pressing step described below, and therefore receives the largest force from the sheet 2 due to the elasticity of the sheet 2. When the thickness of the wax layer 3 on the surface of the elastic body 1 is increased only in the partial region including the apex 1*b*, the wax layer 3 is prevented from becoming excessively thin only at the apex 1*b* in the pressing step described below. In the pressing step, a large force is applied to the elastic body 1 by the sheet 2 in the region around the apex 1*b*. When the thickness of the wax layer 3 in this region is greater than that in the peripheral region, the wax layer 3 is prevented from becoming excessively thin due to the force applied thereto. The apex 1*b* of the elastic body 1 corresponds to a "top portion" according to the present invention. The wax may be manually applied by using, for example, a sponge, or be sprayed by using a spraying device. The applying method and the tool used to apply the wax are not limited to the above-described examples.

<Adhesive Applying Step>

The adhesive 4 is placed on the elastic body 1 in the region including the apex 1*b*. The adhesive 4 flows downward along the surface of the elastic body 1, that is, in the directions of the arrows in FIG. 5, due to gravity. Accordingly, as illustrated in FIG. 6, the adhesive 4 is thinly spread over the bonding surface 1*a* of the elastic body 1. Since the adhesive 4 is spread due to gravity, the adhesive 4 can be applied uniformly over the surface of the elastic body 1, and air bubbles are not easily mixed in the adhesive 4. This step is referred to as an adhesive applying step.

Since the adhesive 4 is applied in the above-described manner, the risk of transfer failure of ink from the printing original plate and transfer failure of ink to the printing object due to air bubbles mixed between the sheet 2 and the elastic body 1 of the printing blanket 10 can be reduced. If the sheet 2 is bonded to the elastic body 1 with the adhesive 4 having air bubbles mixed therein, the air bubbles are easily left between the sheet 2 and the elastic body 1. In such a case, when the printing blanket 10 is pressed against the printing original plate, there is a risk that ink cannot be easily transferred to the sheet 2 in regions where the air bubbles are present. In addition, when the printing blanket 10 is pressed against the printing object, there is a risk that ink cannot be easily transferred to the printing object.

The adhesive 4 is not necessarily spread thinly over the surface of the elastic body 1 as illustrated in FIG. 5. In the case where the adhesive 4 has a high viscosity (is hard), the sheet 2 can also be attached even when the adhesive 4 is not spread from the state illustrated in FIG. 5. This is because the adhesive 4 can be gradually spread downward from the apex 1*b* and the same effect as that in the case where the adhesive 4 is spread due to gravity can be obtained by pressing the elastic body 1 against the sheet 2 at a low speed in the step of pressing the elastic body 1 against the sheet 2 described below.

Preferably, air bubbles mixed in the adhesive 4 are removed from the adhesive 4 before the adhesive applying step. This step is referred to as a debubbling step. When this step is carried out, the amount of air bubbles left between the sheet 2 and the elastic body 1 can be further reduced.

<Pressing Step>

Figure 7:
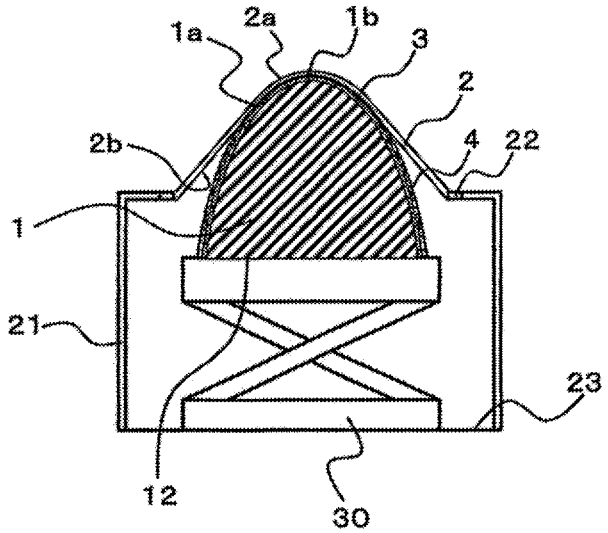
FIG. 7 illustrates a state in which the elastic body is pressed against the sheet from the state illustrated in FIG. 4.

FIG. 7 illustrates a state in which the elastic body 1 is pressed against the sheet 2 from the state illustrated in FIG. 4. The lifter 30 is configured to be vertically extendable, and serves as moving means capable of moving the elastic body 1 in the vertical direction. This step is referred to as a moving step. The bonding surface 1*a* of the elastic body 1 to which the adhesive 4 is applied is pressed against the bonding surface 2*b* of the sheet 2 by the lifter 30. The sheet 2 against which the elastic body 1 is pressed is stretchable, and therefore comes into close contact with the surface of the elastic body 1 to follow the shape thereof while being stretched upward as the elastic body 1 is moved upward. As the sheet 2 comes into close contact with the elastic body 1 to follow the shape thereof, the elastic body 1 is pushed upward so that the adhesive 4 applied to the bonding surface 1*a* is pressed between the elastic body 1 and the sheet 2 and is spread further thinly over the surface of the elastic body 1.

First, the apex 1*b* of the elastic body 1 comes into contact (point contact) with the sheet 2. Subsequently, as the elastic body 1 is further pressed against the sheet 2, the sheet 2 is deformed and the contact area increases while the contact position gradually moves in a direction away from the apex 1*b*. Therefore, air can be prevented from being trapped between the contact surfaces of the sheet 2 and the elastic body 1. According to this step, the sheet 2 can be brought into sufficiently close contact with the bonding surface 1*a* of the elastic body 1 with the adhesive 4 interposed therebetween. The above-described step is referred to as a pressing step. The moving step is included in the pressing step.

In the moving step, the speed at which the elastic body 1 is moved upward is set so that no air bubbles are trapped between the sheet 2 and the adhesive 4. This speed is set as appropriate in accordance with, for example, the amount of the adhesive 4, the viscosity of the adhesive 4, the viscosity of the wax layer 3, the hardness of the material of the sheet 2, and the hardness of the elastic body 1.

<Step of Retaining Sheet 2>

When the sheet 2 is brought into sufficiently close contact with the bonding surface 1*a* of the elastic body 1 with the adhesive 4 interposed therebetween, a process of maintaining the close contact state is performed. For example, the sheet attaching device 20 is retained so that the state thereof is maintained. The method for retaining the sheet 2 while the sheet 2 is in close contact with the bonding surface 1*a* of the elastic body 1 with the adhesive 4 interposed therebetween is not limited to the method of retaining the sheet attaching device 20 so that the state thereof is maintained. For example, the sheet 2 may be fixed with push pins or the like so that the sheet 2 can be retained while being in close contact with the bonding surface 1*a* of the elastic body 1, and then the elastic body 1 with which the sheet 2 is in close contact may be removed from the sheet attaching device 20 and left until the adhesive 4 solidifies. The push pins used to fix the sheet 2 may be replaced by, for example, means such as adhesive tape. The above-described step is referred to as a sheet retaining step.

<Replacement of Sheet 2>

When printing is repeated, the printing surface 13 (surface to which ink is transferred from the printing original plate and which is pressed against the printing object surface so that the ink is transferred to the printing object surface) of the printing blanket 10 is deteriorated and damaged. According to the above-described method for manufacturing the printing blanket 10, the deteriorated sheet 2 can be removed from the elastic body 1, and then a new sheet 2 can be attached to the elastic body 1. The step of removing the sheet 2 from the printing blanket 10 is referred to as a removing step. Thus, the elastic body 1 can be repeatedly used by replacing the sheet 2, and satisfactory printing can be performed continuously at low cost. In Embodiment 1, the wax layer 3 is provided on the surface of the elastic body 1, and therefore the adhesive 4 and the elastic body 1 are not directly bonded to each other. Accordingly, the sheet 2 can be easily removed. When the sheet 2 is removed, the sheet 2 is removed from the surface of the elastic body 1 together with the adhesive 4. Since the wax layer 3 is provided between the surface of the elastic body 1 and the adhesive 4, the adhesive 4 and the surface of the elastic body 1 are not directly bonded to each other, and the surface of the elastic body 1 is not damaged when the sheet 2 and the adhesive 4 are removed.

If a covering member having an inner surface of the same shape as that of the surface of the elastic body 1 and a predetermined thickness is formed in place of the sheet 2 by using a mold, a mold needs to be manufactured for each shape of the elastic body 1. Therefore, the manufacturing cost of the printing blanket is increased. In addition, air may be trapped between the inner surface of the covering member and the elastic body 1 when the covering member is attached to the elastic body 1, and there is a risk that the printing quality will be degraded. However, when the structure and manufacturing method of the printing blanket 10 according to Embodiment 1 are employed, the cost of the printing blanket 10 can be reduced and the quality can be improved.

<Positional Relationship Between Elastic Body 1 and Sheet 2>

In the above-described method for manufacturing the printing blanket 10, the positional relationship between the elastic body 1 and the sheet 2 is not limited to the positional relationship according to Embodiment 1, and may be, for example, vertically inverted. The positional relationship between the elastic body 1 and the sheet 2 may be set as appropriate in accordance with, for example, the shape of the elastic body 1 and the position at which the sheet 2 is attached. For example, when the elastic body 1 is pressed against the sheet 2 from above, the sheet 2 is fixed to, for example, the stand 21 and the adhesive 4 is placed on the sheet 2. The adhesive 4 is placed on the sheet 2 in the region in which the apex 1*b* of the elastic body 1 comes into contact with the sheet 2, and the elastic body 1 provided with the wax layer 3 on the surface thereof is pressed against the sheet 2 from above. The elastic body 1 is attached to a device placed above the stand 21. The device is, for example, a hand press that linearly moves in the vertical direction so that the elastic body 1 is vertically movable. When the elastic body 1 is moved downward and pressed against the sheet 2, the sheet 2 is stretched downward while the periphery thereof is fixed. As the sheet 2 is stretched, the adhesive 4 is spread to follow the shape of the elastic body 1. Accordingly, the adhesive 4 is thinly spread between the sheet 2 and the elastic body 1, and the sheet 2 comes into close contact with the elastic body 1 to follow the shape thereof. Therefore, an effect similar to that in the case where the elastic body 1 is pressed against the sheet 2 from below the sheet 2 can be obtained.

<Lifter 30>

In FIG. 7, the lifter 30 is structured to be capable of vertically moving a table on which the elastic body 1 is placed with a link. However, the structure of the lifter 30 is not limited to this. Any structure that moves linearly to serve as a vertical guide, such as a jack or a hand press, may be used. The power for vertically driving the lifter 30, for example, may be electric or manual, and is not particularly limited as long as the lifter 30 can be moved at a predetermined speed. In addition, although the elastic body 1 is moved upward by the lifter 30 in Embodiment 1, the bonding surface 1*a* of the elastic body 1 may be pressed against the bonding surface 2*b* of the sheet 2 by moving the frame 22 to which the sheet 2 is fixed in a direction toward the elastic body 1. Alternatively, the stand 21 including the frame 22 may be vertically moved to move the sheet 2 toward the elastic body 1. Instead of using a device such as the lifter 30, the sheet 2 may be manually attached to the surface of the elastic body 1.

Effects of Embodiment

According to the method for manufacturing the printing blanket 10 of Embodiment 1, the printing blanket 10 includes the elastic body 1 and the sheet 2 bonded to the surface of the elastic body 1, and performs printing by pressing a surface of the sheet 2 against the printing object surface. The method includes a sheet fixing step of fixing the sheet 2 at the periphery of the region in which the sheet 2 is to be bonded to the elastic body 1; an elastic body placing step of placing the elastic body 1 so that the bonding surface 1*a* of the elastic body 1 faces the bonding surface 2*b* of the sheet 2 that is fixed; a wax applying step of applying the wax layer 3 to the surface of the elastic body 1; an adhesive applying step of applying the adhesive 4 to at least one of the bonding surface 2*b* of the sheet 2 and the bonding surface 1*a* of the elastic body 1; and a pressing step of pressing the bonding surface 2*b* of the sheet 2 and the bonding surface 1*a* of the elastic body 1 against each other and bringing the sheet 2 into close contact with the elastic body 1 with the adhesive 4 interposed therebetween while stretching the sheet 2 along the surface of the elastic body 1. According to the above-described configuration, the sheet 2 can be attached to the surface of the elastic body 1 provided with the layer 3 with less amount of air bubbles trapped between the elastic body 1 and the sheet 2. Since the sheet 2 and the adhesive 4 are attached to the elastic body 1 with the wax layer 3 interposed therebetween, when the sheet 2 is damaged or deteriorated and needs to be replaced, the sheet 2 and the adhesive 4 can be easily removed from the surface of the elastic body 1. Thus, the sheet 2 can be replaced without damaging the surface of the elastic body 1, and the elastic body 1 can be used for a long time. In particular, the elastic body 1 is made of a material having a low hardness, and therefore the surface thereof may be damaged when the sheet 2 is removed. Accordingly, the configuration of Embodiment 1 reduces the risk of damage to the elastic body 1.

The wax applying step includes a first wax applying step of applying wax to the surface of the elastic body 1 over the entire region thereof and a second wax applying step of applying wax to the surface of the elastic body 1 only over a partial region including the apex 1*b*. In such a case, the thickness of the wax layer 3 on the surface of the elastic body 1 can be increased in the partial region including the apex 1*b*. Therefore, in the above-described pressing step in which the sheet 2 is pressed against the elastic body 1, the wax layer 3 can be prevented from being spread by the pressing force applied to the sheet 2 and becoming excessively thin in the region around the apex 1*b* of the elastic body 1. Therefore, when the sheet 2 and the adhesive 4 of the printing blanket 10 are removed from the elastic body 1, the risk that the sheet 2 and the adhesive 4 cannot be easily removed only in the region around the apex 1*b* of the elastic body 1 can be reduced. In the above-described pressing step, the sheet 2 is fixed to the frame 22 and receives a large force in the region around the apex 1*b* of the elastic body 1. In addition, when the sheet 2 is made of a material having an Asker C hardness higher than that of the elastic body 1, the apex 1*b* receives a greater force. Therefore, the wax layer 3 may receive a large force and be compressed and spread in the region around the apex 1*b*. Accordingly, the second wax applying step may be repeated a plurality of times.

In the above-described adhesive applying step, the adhesive 4 is placed on an upper portion of the elastic body 1 that is provided with the wax layer 3, and is applied to the wax layer 3. Therefore, the wax layer 3 can be easily maintained in the state in which the wax layer 3 is applied to the surface of the elastic body 1 in the wax applying step. The adhesive 4 may be spread by causing the adhesive 4 to flow in the direction of gravity. Alternatively, when the adhesive 4 does not flow due to gravity, the adhesive 4 may be spread over the surface of the elastic body 1 by pressing the elastic body 1 against the sheet 2. If, for example, the adhesive 4 is spread by using a tool such as a spatula, there is a risk that the wax layer 3 will also be spread by the tool. In such a case, the thickness distribution of the wax layer 3 may be changed from that in the wax applying step. However, according to the above-described adhesive applying step, the adhesive 4 can be applied with minimum change in the thickness distribution of the wax layer 3. However, the step of applying the adhesive 4 is not limited to the above-described method.

Embodiment 2

A printing blanket 210 according to Embodiment 2 differs from the printing blanket 10 according to Embodiment 1 in the shape of the elastic body 1. Therefore, the printing blanket 210 and the printing blanket 10 have different shapes and have the sheet 2 attached in different regions. In Embodiment 2, differences from Embodiment 1 will be mainly described.

Figure 8:
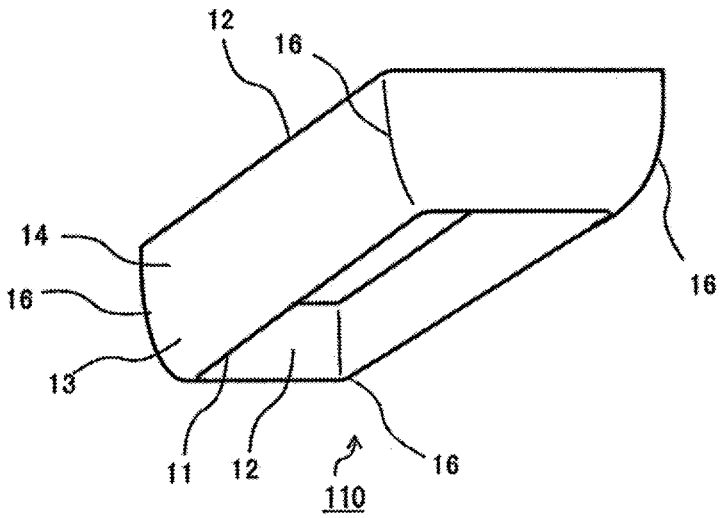
FIG. 8 is a perspective view of a printing blanket according to Embodiment 2 of the present invention.
Figure 9:
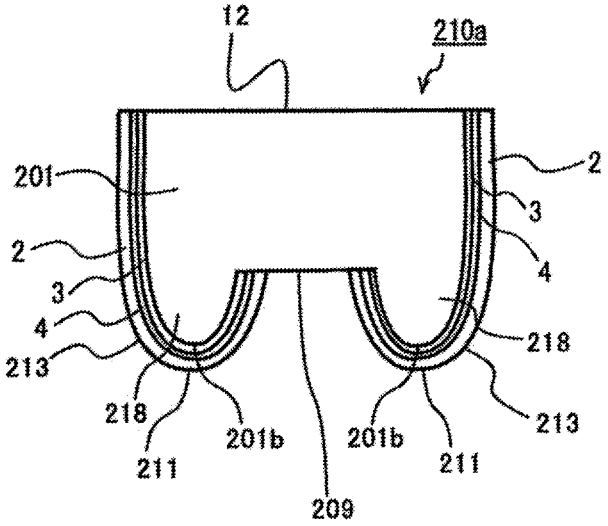
FIG. 9 is a sectional view of the printing blanket illustrated in FIG. 8 taken along a plane perpendicular to a bottom surface of the printing blanket.
Figure 10:
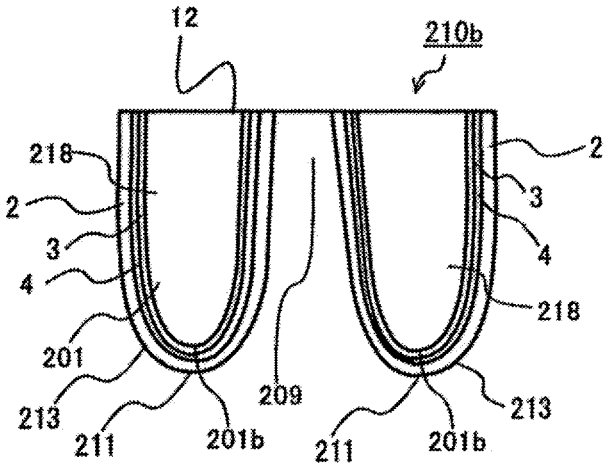
FIG. 10 is a sectional view of the printing blanket illustrated in FIG. 8 taken along a plane perpendicular to the bottom surface of the printing blanket.

FIG. 8 is a perspective view of the printing blanket 210 according to Embodiment 2 of the present invention. FIGS. 9 and 10 are sectional views of the printing blanket 210 illustrated in FIG. 8 taken along a plane perpendicular to the bottom surface 12. The printing blanket 210 illustrated in FIG. 8 includes an elastic body 201 having a recess 209 in a central region thereof. When the printing blanket 210 is pressed against a printing original plate or a printing object, which serves as an object to be subjected to printing, a ridge 211 that surrounds the recess 209 comes into contact with the printing original plate or the printing object first. The printing blanket 210 is pressed against the printing original plate on which ink is placed, so that the ink is transferred to a printing surface 213 on the surface of the printing blanket 210, and then the printing surface 213 is pressed against the printing object, so that the ink is transferred to the printing object. Thus, the printing object is subjected to printing.

The printing blanket 210 has a substantially rectangular shape when viewed from a location where the printing original plate and the printing object are disposed in a printing apparatus, that is, from below in FIGS. 9 and 10. The printing blanket 210 has the recess 209 in the central region thereof. The recess 209 is surrounded by a projecting portion 218 formed at an end of the printing blanket 210. The projecting portion 218 projects downward from the bottom surface 12. More specifically, when the cross sectional shape of the projecting portion 218 illustrated in FIGS. 9 and 10 is continuously arranged along a closed line having a start point and an end point connected to each other, the recess 209 is a portion surrounded by the projecting portion 218. The ridge 211, which corresponds to the apex 1*b* in the cross section of the projecting portion 218, is rounded. The curvature of the ridge 211 may be changed as appropriate in accordance with the shape of, for example, a curved surface of the printing object. The shape of the ridge 211 is not limited to a curved shape having a predetermined curvature, and may instead be a shape such that flat surfaces meet at the ridge 211 or a shape such that a flat surface and a curved surface meet at the ridge 211.

Corners 16 of the printing blanket 210 having a substantially rectangular shape when viewed from below are rounded. The rounded shape of the corners 16 may also be changed as appropriate in accordance with the shape of the printing object.

The sectional views of FIGS. 9 and 10 show examples of the cross sectional shape of the printing blanket 210. Printing blankets 210*a* and 210*b* differ from the printing blanket 10 in the shape of the elastic body 201. The elastic body 201 is formed to have a shape corresponding to the shape of the printing blanket 210. The printing blanket 210 is formed by covering the elastic body 201 with the wax layer 3, the adhesive 4, and the sheet 2. The printing blanket 210 may be formed by attaching two or more sheets 2.

Unlike Embodiment 1, the printing blankets 210*a* and 210*b* illustrated in FIGS. 9 and 10 each include the projecting portion 218 that surrounds the recess 209 at the center. Therefore, the sheet 2 is attached to extend along the projecting portion 218. Accordingly, the wax layer 3 is applied to the surface of the projecting portion 218 to which the sheet 2 is attached. Similar to Embodiment 1, the printing blankets 210*a* and 210*b* are preferably configured such that wax is applied to the surface of the elastic body 201*a* plurality of times to increase the thickness of the wax layer 3 only in a partial region including the ridge 201*b*, which is the top portion of the elastic body 201. The ridge 201*b* of the elastic body 201 corresponds to the "top portion" according to the present invention.

The printing blanket 210 according to Embodiment 2 is also configured such that the sheet 2 and the adhesive 4 are attached to the elastic body 1 with the wax layer 3 interposed therebetween. Therefore, when the sheet 2 is damaged or deteriorated and needs to be replaced, the sheet 2 and the adhesive 4 can be easily removed from the surface of the elastic body 201. Accordingly, only the sheet 2 can be replaced without damaging the surface of the elastic body 201, and the elastic body 1 can be used for a long time. In the step of attaching the sheet 2, the sheet 2 may be fixed to the recess 209 with, for example, push pins to bond the sheet 2 to the printing blanket 210*a*. The sheet 2 fixed to the recess 209 may be left uncut on the recess 209.

REFERENCE SIGNS LIST

1 elastic body 1*a* bonding surface 1*b* apex 2 sheet 2*a* bonding region 2*b* bonding surface 3 wax layer 4 adhesive 10 printing blanket 11 apex 12 bottom surface 13 printing surface 16 corner 20 sheet attaching device 21 stand 22 frame 23 bottom surface 30 lifter 201 elastic body 201*b* ridge 209 recess 210 printing blanket 210*a* printing blanket 210*b* printing blanket 211 ridge 213 printing surface 218 projecting portion

The invention claimed is:

1. A method for manufacturing a printing blanket that includes an elastic body and a sheet bonded to the elastic body and that performs printing by pressing the sheet against a printing object surface, the method comprising:

a sheet fixing step of fixing the sheet at a periphery of a region in which the sheet is to be bonded to the elastic body;

an elastic body placing step of placing the elastic body so that a bonding surface of the elastic body faces a bonding surface of the sheet that is fixed, the bonding surface of the elastic body comprising an apex in a top portion thereof that faces the bonding surface of the sheet;

a wax applying step of applying wax on a surface of the elastic body to form a waxed elastic body with a waxed apex in the top portion thereof;

an adhesive applying step of applying an adhesive to at least one of the sheet and the the banding surface of the waxed elastic body; and a pressing step of pressing the sheet and the waxed elastic body against each other and bringing the sheet into close contact with the waxed elastic body such that the adhesive is interposed therebetween while stretching the sheet along a bonding surface of the waxed elastic body, wherein, in the pressing step, the apex in the top portion of the waxed elastic body comes into contact with the sheet before other portions of the waxed elastic body such that a force of the pressing is greater on the top portion than in other portions of the waxed elastic body, and wherein the wax applying step comprises applying a thicker coating of wax on the top portion of the waxed elastic body than in the other portions of the waxed elastic body to counteract an effect of the greater force in thinning wax on the top portion more than on the other portions of the waxed elastic body.

2. The method for manufacturing the printing blanket of claim 1, wherein the wax applying step includes a first wax applying step of applying wax to the surface of the elastic body over a first portion thereof, and a second wax applying step of applying wax to the surface of the waxed elastic body only over a partial region of the first portion, the partial region including the top portion of the elastic body.

3. The method for manufacturing the printing blanket of claim 1, wherein, in the sheet fixing step, the sheet is fixed to a frame that surrounds the region in which the sheet is to be bonded to the elastic body.

4. The method for manufacturing the printing blanket of claim 1, wherein, in the elastic body placing step, the elastic body is placed such that the sheet and the surface of the elastic body face each other in a vertical direction.

5. The method for manufacturing the printing blanket of claim 4, wherein, in the elastic body placing step, the elastic body is placed such that the surface of the elastic body faces upward, and wherein, in the adhesive applying step, the adhesive is placed on the top portion of the waxed elastic body.

6. The method for manufacturing the printing blanket of claim 4, wherein the pressing step includes a moving step of linearly moving at least one of the waxed elastic body and the sheet in the vertical direction by using moving means.

7. The method for manufacturing the printing blanket of claim 1, further comprising a removing step of removing the sheet and the adhesive from the waxed elastic body.

8. A printing blanket comprising:

an elastic body comprising an apex in a top portion thereof;

a wax layer that covers a surface of the elastic body;

an adhesive that covers the wax layer; and a sheet that covers the adhesive, wherein a surface of the sheet includes a printing surface to which ink is transferred, and wherein a thickness of the wax layer on the surface of the elastic body in a partial region including a top portion of the elastic body is greater than a thickness of the wax layer in other regions.

9. The printing blanket of claim 8, wherein the wax layer includes carnauba wax.

* * * * *